US010822679B2

(12) United States Patent
Kaminaka et al.

(10) Patent No.: US 10,822,679 B2
(45) Date of Patent: Nov. 3, 2020

(54) STAINLESS STEEL PRODUCT

(71) Applicant: NIPPON STEEL & SUMITOMO METAL CORPORATION, Tokyo (JP)

(72) Inventors: Hideya Kaminaka, Tokyo (JP); Shinya Yamamoto, Tokyo (JP); Hiroshi Kamio, Tokyo (JP); Kouichi Takeuchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 274 days.

(21) Appl. No.: 15/513,595

(22) PCT Filed: Sep. 30, 2015

(86) PCT No.: PCT/JP2015/077786
§ 371 (c)(1),
(2) Date: Mar. 23, 2017

(87) PCT Pub. No.: WO2016/052639
PCT Pub. Date: Apr. 7, 2016

(65) Prior Publication Data

US 2018/0230580 A1 Aug. 16, 2018

(30) Foreign Application Priority Data

Oct. 1, 2014 (JP) ..... 2014-203317

(51) Int. Cl.
*C22C 38/42* (2006.01)
*C22C 38/44* (2006.01)
(Continued)

(52) U.S. Cl.
CPC ..... *C22C 38/48* (2013.01); *C21C 7/0075* (2013.01); *C21C 7/06* (2013.01); *C21C 7/072* (2013.01);
(Continued)

(58) Field of Classification Search
CPC ..... C22C 38/002; C22C 38/04; C22C 38/02; C22C 38/06; C22C 38/42; C22C 38/44;
(Continued)

(56) References Cited

U.S. PATENT DOCUMENTS

| | | | | |
|---|---|---|---|---|
| 6,036,917 | A | 3/2000 | Sorace et al. | |
| 2004/0042926 | A1* | 3/2004 | Shimizu | C22C 38/04 420/38 |
| 2008/0142123 | A1* | 6/2008 | Takahashi | C21D 8/0468 148/504 |

FOREIGN PATENT DOCUMENTS

| | | |
|---|---|---|
| CN | 103842547 | 6/2014 |
| JP | 53-091024 | 8/1978 |

(Continued)

OTHER PUBLICATIONS

JP-2003268504-A machine translation, 13 pages. (Year: 2003).*

(Continued)

*Primary Examiner* — Matthew E. Hoban
*Assistant Examiner* — Lynne Edmondson
(74) *Attorney, Agent, or Firm* — Clark & Brody LP

(57) ABSTRACT

Provided is a stainless steel product having a chemical composition consisting of C: less than 0.05%, Si: 4.0 to 7.0%, Mn: 1.50% or less, P: 0.030% or less, S: 0.030% or less, Cr: 10.0 to 20.0%, Ni: 11.0 to 17.0%, Cu: 0.15 to 1.5%, Mo: 0.15 to 1.5%, Nb: 0.5 to 1.2%, Sol. Al: 0 to 0.10%, Mg: 0 to 0.01%, and balance Fe and impurities, wherein $MgO.Al_2O_3$ inclusions constitute an area fraction of 0.02% or less. This stainless steel product has excellent corrosion resistance to hot concentrated sulfuric acid of approximately 93 to 99% concentration, for example, and also is economically advantageous.

2 Claims, 3 Drawing Sheets

(51) Int. Cl.

| | |
|---|---|
| ***C22C 38/48*** | (2006.01) |
| ***C21C 7/06*** | (2006.01) |
| ***C22C 38/50*** | (2006.01) |
| ***C21C 7/00*** | (2006.01) |
| ***C22C 38/00*** | (2006.01) |
| ***C21C 7/10*** | (2006.01) |
| ***C21C 7/072*** | (2006.01) |
| ***C22C 38/04*** | (2006.01) |
| ***C22C 38/06*** | (2006.01) |
| ***C22C 38/34*** | (2006.01) |
| *C21C 7/04* | (2006.01) |

(52) U.S. Cl.
CPC ..... *C21C 7/10* (2013.01); *C22C 38/00* (2013.01); *C22C 38/001* (2013.01); *C22C 38/002* (2013.01); *C22C 38/005* (2013.01); *C22C 38/04* (2013.01); *C22C 38/06* (2013.01); *C22C 38/34* (2013.01); *C22C 38/42* (2013.01); *C22C 38/44* (2013.01); *C22C 38/50* (2013.01); *C21C 7/04* (2013.01)

(58) Field of Classification Search
CPC ..... C22C 38/00; C22C 38/004; C22C 38/48; C22C 38/40; C22C 38/12; C22C 38/18; C22C 38/34; C22C 38/08; C22C 38/16; C22C 38/20; C22C 38/22; C22C 38/26; C22C 19/05; C22C 19/058; C22C 30/02; C21C 7/06
USPC ..... 148/320, 332, 336, 605, 225, 325, 327, 148/592, 38, 61, 89; 420/120, 38, 61, 89
See application file for complete search history.

(56) References Cited

FOREIGN PATENT DOCUMENTS

| | | | |
|---|---|---|---|
| JP | 57-41356 | | 3/1982 |
| JP | 02-290949 | | 11/1990 |
| JP | 11-314906 | | 11/1999 |
| JP | 2003268504 | A * | 9/2003 |
| JP | 2007-270350 | | 10/2007 |
| JP | 2007-284799 | | 11/2007 |
| KR | 2001-0101291 | | 12/2006 |
| KR | 2014-0040864 | | 4/2014 |
| WO | 2013/018629 | | 3/2015 |

OTHER PUBLICATIONS

Park et al., "Thermodynamic investigation on the formation of inclusions containing MgAl2O4 spinel during 16Cr-14Ni austentic stainless steel manufacturing process", Materialsw Science & Engineering A 472, pp. 43-51. (Year: 2008).*

* cited by examiner

STAINLESS STEEL PRODUCT

TECHNICAL FIELD

The present invention relates to a stainless steel product.

BACKGROUND ART

Sulfuric acid is a useful basic chemical that is used in a wide variety of applications, for example, as a material for agricultural fertilizers, as a material for extracting copper from ores, and as a material for synthetic fibers, paper, and construction materials. Processes for producing sulfuric acid can be generally categorized into two classes. One is a process of production carried out by reacting sulfur recovered in petroleum refining processes with water and combusting it. The other is a process of production carried out by reacting sulfurous gas emitted from, for example, nonferrous smelting with water. The former process accounts for about two thirds of the world production and the latter process accounts for about one third thereof.

Commercially available purified dilute sulfuric acids contain sulfuric acid ($H_2SO_4$) in an amount ranging from 27 to 50%, and the purified concentrated sulfuric acids contain sulfuric acid ($H_2SO_4$) in an amount ranging from 90 to 100%, and there are standard products such as a 34% purified dilute sulfuric acid and 95% and 98% purified concentrated sulfuric acids (The Sulfuric Acid Association of Japan Standard, Sulfuric Acid-2010, Quality). The dilute sulfuric acid mentioned above is prepared from approximately 93 to 99% hot concentrated sulfuric acid.

Sulfuric acid obtained in the production process is a hot concentrated sulfuric acid of approximately 93 to 99% concentration. For equipment used for production of such sulfuric acid, silicon cast iron or a brick lining, for example, have been used. However, materials such as silicon cast iron and brick lining are fragile and therefore are not easy to handle.

Stainless steel has been increasingly employed for use in environments in which corrosion events such as a sulfuric acid dew point corrosion frequently occur, but few attempts have been made to use stainless steel against hot concentrated sulfuric acid as described above. In the following, conventional technologies that have begun the use are described.

Patent Document 1 discloses application of an austenitic/ferritic iron alloy including silicon, cobalt, and tungsten or an austenitic iron alloy including silicon, rare earth, magnesium, and aluminum to an apparatus for concentrating and purifying sulfuric acid.

Patent Document 2 discloses a corrosion resistant austenitic stainless steel. Patent Document 2 discloses that its austenitic stainless steel (14Cr-16Ni-6Si-1.0Cu-1.1Mo) is a hot concentrated sulfuric acid-resistant steel having excellent economic advantages that are achieved by the reduced Ni content in the chemical composition.

Patent Document 3 discloses an austenitic stainless steel having a predetermined chemical composition and in which a total amount of $B_1$ type inclusions measured by a method according to HS G0555 (2003) Annex 1 "Microscopic Testing for the Non-Metallic Inclusions on the Point Counting Principle" is not more than 0.03% by area.

Other examples of known hot concentrated sulfuric acid-resistant steels include UNS S32615 steel (17Cr-19Ni-5.4Si-2.1Cu-0.4Mo) and UNS S30601 steel (17.5Cr-17.5Ni-5.3Si-0.2Cu).

LIST OF PRIOR ART DOCUMENTS

Patent Document

Patent Document 1: JP11-314906A
Patent Document 2: JP2007-284799A
Patent Document 3: WO 2013/018629

SUMMARY OF INVENTION

Technical Problem

The iron alloy of Patent Document 1 poses problems from an economic standpoint because cobalt and tungsten are expensive and less available elements. Furthermore, austenitic iron alloys including rare earth, magnesium, and aluminum are difficult to produce because the rare earth, magnesium, and aluminum act as deoxidizers in the process of steel making. In addition, depending on the environment, it is necessary to apply surface passivation treatment with 95 to 100% nitric acid prior to use.

The austenitic stainless steel disclosed in Patent Document 2 contains large amounts of Mo, which is expensive, and therefore the economic advantage enhanced by the reduced Ni decreases.

The invention of Patent Document 3 is intended to control $B_1$ type inclusions, namely oxides such as $Al_2O_3$, which are responsible for degradation of corrosion resistance. However, specific examples of the $B_1$ type inclusions are not mentioned.

UNS S32615 steel (17Cr-19Ni-5.4Si-2.1Cu-0.4Mo) is expensive because of the high Ni content. In addition, the high Si and Cu contents may cause embrittlement during hot working and therefore the production process is limited. For example, there is a strict upper limit to the pre-rolling heating temperature and this necessitates rolling with reheating, for example. As a result, the production costs increase. Furthermore, when constructing a plant using the product, problems associated with the construction work, such as high cracking susceptibility during welding, are encountered.

UNS S30601 steel (17.5Cr-17.5Ni-5.3Si-0.2Cu) relies only on Si for its resistance to hot concentrated sulfuric acid and therefore exhibits lower corrosion resistance in 93% concentrated sulfuric acid environments than certain other steels such as UNS S32615 steel.

As described above, stainless steel has been increasingly employed for use in environments in which corrosion events such as a sulfuric acid dew point corrosion frequently occur, but few attempts have heretofore been made to use stainless steel against hot concentrated sulfuric acid.

An object of the present invention is to provide a stainless steel product that exhibits excellent corrosion resistance to hot concentrated sulfuric acid of approximately 93 to 99% concentration, for example, and which is also economically advantageous.

Solution to Problem

The present inventors made intense research to solve the problems described above, and consequently made the following findings (A) to (D) to accomplish the present invention.

(A) In order to reduce costs by reducing the contents of Ni and Mo, the Ni content is to be limited to at most 17% (hereinafter "%" used in the context of chemical composition refers to "mass %" unless otherwise specified) and the Mo content is to be limited to at most 1.5% and preferably 1.0%.

(B) Addition of small amounts of Nb can improve the cracking susceptibility during welding, which is a problem associated with high Si-content stainless steel products, and also can inhibit a decrease in corrosion resistance of the weld zone.

(C) It has been found that, in high Si-content stainless steel products, $MgO.Al_2O_3$ inclusions act as corrosion initiation sites in 93 to 98% sulfuric acid environments. In general, $Al_2O_3$ inclusions and $MgO.Al_2O_3$ inclusions are placed in the same category as $B_1$ type inclusions (see Patent Document 3). However, $MgO—Al_2O_3$ inclusions result in larger exposed areas of the surface because MgO dissolves in concentrated sulfuric acid. As a result, the corrosion resistance decreases further than in the case of $Al_2O_3$ inclusions. Thus, it is important to appropriately control the amount of precipitation of $MgO—Al_2O_3$ inclusions. That is, by reducing the amount of exposure of $MgO.Al_2O_3$ inclusions and preventing their precipitation in a continuous form, i.e., by reducing the size of the precipitates of the inclusions and causing their dispersion, it is possible to increase the resistance to hot concentrated sulfuric acid.

(D) By optimizing the chemical composition as described in the above (A) and (B), and in combination with this, optimizing the degree of dispersion (amount of exposure) of the precipitates of $MgO.Al_2O_3$ inclusions as described in the above (C) (or further optimizing the size of the precipitates), it is possible to significantly increase the resistance to hot concentrated sulfuric acid than that of conventional stainless steel products.

The present invention is as set forth below.

(1) A stainless steel product having a chemical composition containing, by mass, C: less than 0.05%,
Si: 4.0 to 7.0%,
Mn: 1.50% or less,
P: 0.030% or less,
S: 0.030% or less,
Cr: 10.0 to 20.0%,
Ni: 11.0 to 17.0%,
Cu: 0.15 to 1.5%,
Mo: 0.15 to 1.5%,
Nb: 0.5 to 1.2%,
Sol. Al: 0 to 0.10%,
Mg: 0 to 0.01%,
and balance Fe and impurities, wherein $MgO.Al_2O_3$ inclusions constitute an area fraction of 0.02% or less.

(2) The stainless steel product according to the above (1), wherein the $MgO.Al_2O_3$ inclusions have an average particle size of 5.0 μm or less.

The "area fraction" and the "average particle size" in the present invention can be determined in the following manner.

1) A test specimen is produced by embedding an area of 20 mm by 10 mm of a steel product to be examined in such a manner that the surface of the steel product can be an observation surface. (The plate surface needs to be observed because corrosion develops from the surface, which is subjected to contact with a solution.)
2) The test specimen is polished at the surface with emery paper and finish polished with #1200.
3) The finish polished test specimen is subjected to mapping analysis of Al, Mg, and O using an EPMA.
4) In the obtained mapping images, inclusions that exist at sites where Al, Mg, and O are all detected are assumed to be $MgO.Al_2O_3$ inclusions.
5) The area fraction is determined as follows: the mapping field of a 0.5 $mm^2$ area of the cross section of the sampled test piece, observed at a magnification of 100×, is subjected to image processing analysis, and after binarization, the area fraction of the inclusions is calculated by an image processing and analysis system. The number of fields to be observed is 30 fields or more.
6) The "average particle size" is defined as the equivalent circular diameter of the inclusions determined by the image processing and analysis after binarization.

Advantageous Effects of Invention

The present invention provides a stainless steel product having excellent resistance to concentrated sulfuric acid. This stainless steel product exhibits excellent corrosion resistance to hot concentrated sulfuric acid of approximately 93 to 99% concentration, for example, and also is economically advantageous. Hence, this stainless steel product is suitable for forming, for example, equipment for producing hot concentrated sulfuric acid or plant equipment for producing chemicals, fertilizers, fibers, or others that are obtainable by using sulfuric acid as a basic material.

DESCRIPTION OF EMBODIMENTS

Figure 1:
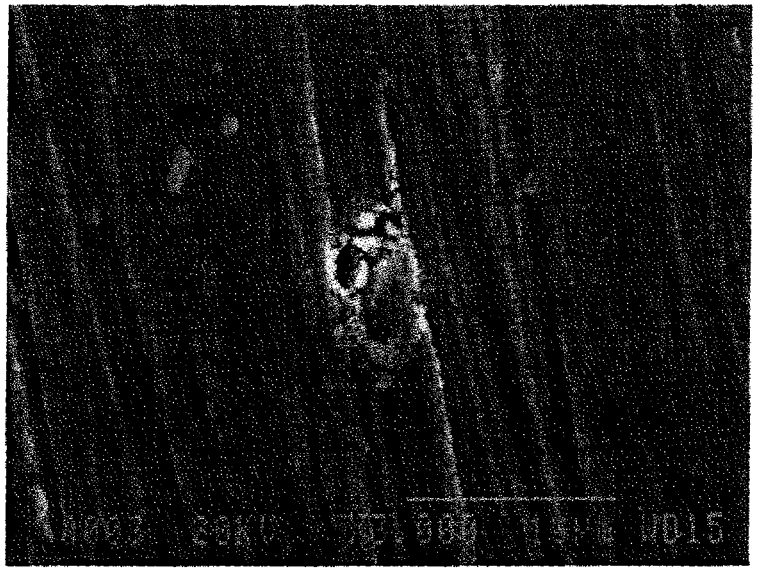
FIG. 1 is an SEM image of a surface of a steel product of the present invention (Inventive Example 1 in Examples) after having been immersed in a 98% sulfuric acid at 55° C. for 96 hours, with a corrosion attacked region shown in the image.

In the following, descriptions are given of the principle of the present invention (basic findings for accomplishment of the invention), the chemical composition, $MgO.Al_2O_3$ inclusions, and the production method, in order.

1. Principle of the Present Invention

The present inventors made intense research to solve the problems described above and have made the following findings (A) to (D). Corrosion that occurs in the presence of greater than 90% concentrated sulfuric acid is caused by a mechanism quite different from a mechanism by which corrosion that occurs in the presence of dilute sulfuric acid is caused. The following are the obtained findings.

(A) A steady-state reaction of stainless steel with concentrated sulfuric acid can be expressed by the following formulas I and II, where M represents the constituent metal elements of the stainless steel.

$$\text{(Film formation) } mM+nH_2SO_4 \rightarrow M_mO_n+nSO_2+nH_2O \quad \text{(I)}$$

$$\text{(Film dissolution) } M_mO_n+nH_2SO_4 \rightarrow M_m(SO_4)_n+nH_2O \quad \text{(II)}$$

When the $M_mO_n$, which is formed by the reaction of Formula I, is stable in the concentrated sulfuric acid, it is assumed that the corrosion resistance is good.

Sulfuric acid having a sulfuric acid concentration of greater than 90% is highly oxidizing and sometimes causes transpassive corrosion in stainless steel. That is, the Cr passivation film, which generally guarantees the corrosion resistance of stainless steel, becomes dissolved in concentrated sulfuric acid (the reaction of Formula II proceeds).

(B) Fe has the effect of protecting the material by forming a film of iron sulfate (i.e., carbon steel is corrosion resistant in concentrated sulfuric acid environments in which there is no flow velocity), but in concentrated sulfuric acid environments in which there is a flow velocity, the $FeSO_4$ film becomes dissolved and therefore cannot exhibit sufficient protection ability.

Si exhibits the ability to protect the surface as a Si—O oxide film in highly oxidizing concentrated sulfuric acid environments, and exhibits the ability to improve corrosion resistance in greater than 90% sulfuric acid environments. However, Si is an element that causes a decrease in hot workability of stainless steel and increases the probability of sensitization.

(C) Addition of Si increases the probability of sensitization, but it has been found that addition of small amounts of Nb produces the effect of inhibiting sensitization. It has been found that addition of small amounts of Nb causes fine NbC to precipitate. Fixation of carbon by Nb may enable inhibition of formation of the Cr depleted layer, which is responsible for sensitization. It should be noted that NbC itself has resistance to concentrated sulfuric acid.

(D) Even materials having increased resistance to concentrated sulfuric acid due to addition of Si can be attacked by pitting corrosion. In regions having pitting corrosion, Mg, Al, and O are inevitably detected. This indicates that $MgO.Al_2O_3$ inclusions present in steel act as corrosion initiation sites. An effective way to enhance resistance to concentrated sulfuric acid is to control, for example, the morphologies and quantity of $MgO.Al_2O_3$ inclusions.

2. Chemical Composition

[C: Less Than 0.05%]

C is a solid solution strengthening element and contributes to improvement in strength. However, an excessively high C content may cause formation of carbides during the production process, which may result in decreased workability and corrosion resistance. Accordingly, the C content is to be less than 0.05%. In order for the effect to be produced, the content is preferably not less than 0.01%.

[Si: 4.0 to 7.0%]

The Si oxide film, which is formed by the reaction of Formula I described above, is insoluble in concentrated sulfuric acid, and therefore Si is an element that guarantees corrosion resistance. In order for this effect to be produced, the Si content is to be not less than 4.0%. To produce the effect sufficiently, the content is preferably not less than 4.5%. On the other hand, Si causes degradation of hot workability and increases the probability of sensitization. Accordingly, the upper limit of the Si content is 7.0% and preferably the upper limit is 6.0%.

[Mn: Not Greater Than 1.50%]

Mn is an element that promotes austenization and contributes to reducing costs as an alternative element to Ni. However, a Mn content of greater than 1.50% decreases the resistance to concentrated sulfuric acid. Accordingly, the Mn content is to be not greater than 1.50%. The lower limit of the Mn content is preferably 0.10%. Scrap utilized as a raw material for stainless steel contains Mn. If the Mn content is to be reduced to less than 0.10%, the amount of scrap needs to be limited, which contrarily can cause an increase in cost because, for example, the use of a low Mn content material is necessitated.

[P: Not Greater Than 0.030%, S: Not Greater Than 0.030%]

Both P and S are elements detrimental to corrosion resistance and weldability, with S in particular being also a detrimental element to hot workability, and therefore the contents of both elements are preferably as low as possible. The detrimental natures of P and S both significantly increase if their contents exceed 0.030%. Accordingly, the contents of P and S are both to be not greater than 0.030%.

[Cr: 10.0 to 20.0%]

Cr is a basic element for ensuring the corrosion resistance of stainless steel and guarantees the corrosion resistance in the case where the sulfuric acid concentration is decreased. If the Cr content is less than 10.0%, sufficient corrosion resistance cannot be ensured. Accordingly, the Cr content is to be not less than 10.0%. Preferably, the Cr content is not less than 14.0%. On the other hand, if the Cr content is excessively high, its coexistence with Si or another element causes a duplex structure with the ferrite being precipitated, which results in a decrease in workability, impact resistance, and other properties, and therefore the upper limit of Cr content is to be 20.0%.

[Ni: 11.0 to 17.0%]

Ni is an element that stabilizes the austenite phase. A Ni content of less than 11.0% is insufficient to form a single phase of austenite. Accordingly, the Ni content is to be not less than 11.0%. Preferably, the Ni content is not less than 13.0%. On the other hand, an excessively high Ni content compromises the economic advantage and therefore the upper limit of the Ni content is to be 17.0%. Preferably, the upper limit of the Ni content is 15.5%.

[Cu: 0.15 to 1.5%]

Cu is an element that promotes austenization and further is an element that, in dilute sulfuric acid environments, reduces the active dissolution current density to improve the corrosion resistance. Even when a material is intended for use in concentrated sulfuric acid environments, the sulfuric acid concentration may not always be constant, and a situation in which the concentration falls below 90% and the oxidizing power decreases may occur. For cases where the environment is shifted to such a state, inclusion of Cu is effective to ensure corrosion resistance. In order for this effect to be produced, the Cu content is to be not less than 0.15% and preferably not less than 0.3%. On the other hand, when included in excessive amounts, Cu segregates at grain boundaries in a hot production process to cause significant degradation of hot workability and therefore decreases the ease of production. Accordingly, the upper limit of the Cu content is to be 1.5% and preferably 1.0%.

[Mo: 0.15 to 1.5%]

Mo is an element that, in synergy with Cu, increases the stacking fault energy to inhibit accumulation of strain in the austenite matrix. Accordingly, to inhibit excessive work hardening to improve formability, the Mo content is to be not less than 0.15%. In addition, similarly to Cu, Mo is an element that, in dilute sulfuric acid environments, reduces the active dissolution current density to improve the corrosion resistance. Even when a material is intended for use in concentrated sulfuric acid environments, the sulfuric acid concentration may not always be constant, and a situation in which the concentration falls below 90% and the oxidizing power decreases may occur. For cases where the environment is shifted to such a state, inclusion of Mo is effective to ensure corrosion resistance. In order for this effect to be produced, the Mo content is to be not less than 0.15% and preferably not less than 0.3%. On the other hand, Mo is an expensive element and decreases the economic advantage when included in large amounts. Accordingly, the upper limit of the Mo content is to be 1.5% and preferably 1.0%.

[Nb: 0.5 to 1.2%]

Nb forms carbides and nitrides and produces the pinning effect to inhibit the grain growth of the crystal grains and refine the crystal grains, and therefore has the effect of improving the formability. Furthermore, within an appropriate range of content, Nb fixes C or N to inhibit formation of Cr carbo-nitrides, which are responsible for formation of the Cr depleted layer, and thereby inhibits sensitization in the base metal and weld heat affected zone. In addition, it has been found that the chemical composition of the present invention produces the effect of decreasing the weld cracking susceptibility. In order for such effects to be produced, Nb is to be included in an amount of not less than 0.5%. However, an excessively high Nb content may cause precipitation of a heterophase called G-phase, which may act as a corrosion initiation site, and therefore the upper limit of the Nb content is to be 1.2% and preferably 1.0%.

[Sol. Al: 0 to 0.10%]

Acid-soluble Al (so-called "Sol. Al") is an element that constitutes $MgO.Al_2O_3$ inclusions and therefore the content is preferably to be as low as possible. Accordingly, the Sol. Al content is to be 0.10%. Preferably, the Sol. Al content is to be as low as possible and therefore the lower limit is not particularly specified.

[Mg: 0 to 0.010%]

Mg is also an element that constitutes $MgO.Al_2O_3$ inclusions and therefore the content is preferably to be as low as possible. Accordingly, the Mg content is to be 0.010%. Mg is a component that comes from fire bricks and therefore limiting the content to less than 0.001% results in an increase in production cost. Accordingly, the content is preferably to be not less than 0.001%.

The balance, other than the elements described above, is made up of Fe and impurities. In the production of stainless steel, scrap materials are often used from the standpoint of promoting recycling. As a result, various impurity elements are incidentally included in stainless steel. Thus, it is difficult to uniquely specify the content of impurity elements. Accordingly, impurities in the present invention mean elements that can be contained in an amount that does not interfere with the effects and advantages of the present invention.

3. $MgO.Al_2O_3$ Inclusions (3-1) Area Fraction: Not Greater Than 0.02%

The present invention defines an area fraction of $MgO.Al_2O_3$ inclusions.

FIG. 1 is an SEM image of a surface of a steel product of the present invention (Inventive Example 1 in Examples to be described later) after having been immersed in a 98% sulfuric acid at 55° C. for 96 hours, with a corrosion attacked region shown in the image.

As shown in FIG. 1, the steel product of the present invention is corrosion resistant in most of the matrix as indicated by the polishing damage remaining in the surface even after immersion, but traces of pitting corrosion are spread out. The pitting corrosion trace regions were analyzed by SEM-EPMA mapping.

Figure 2:
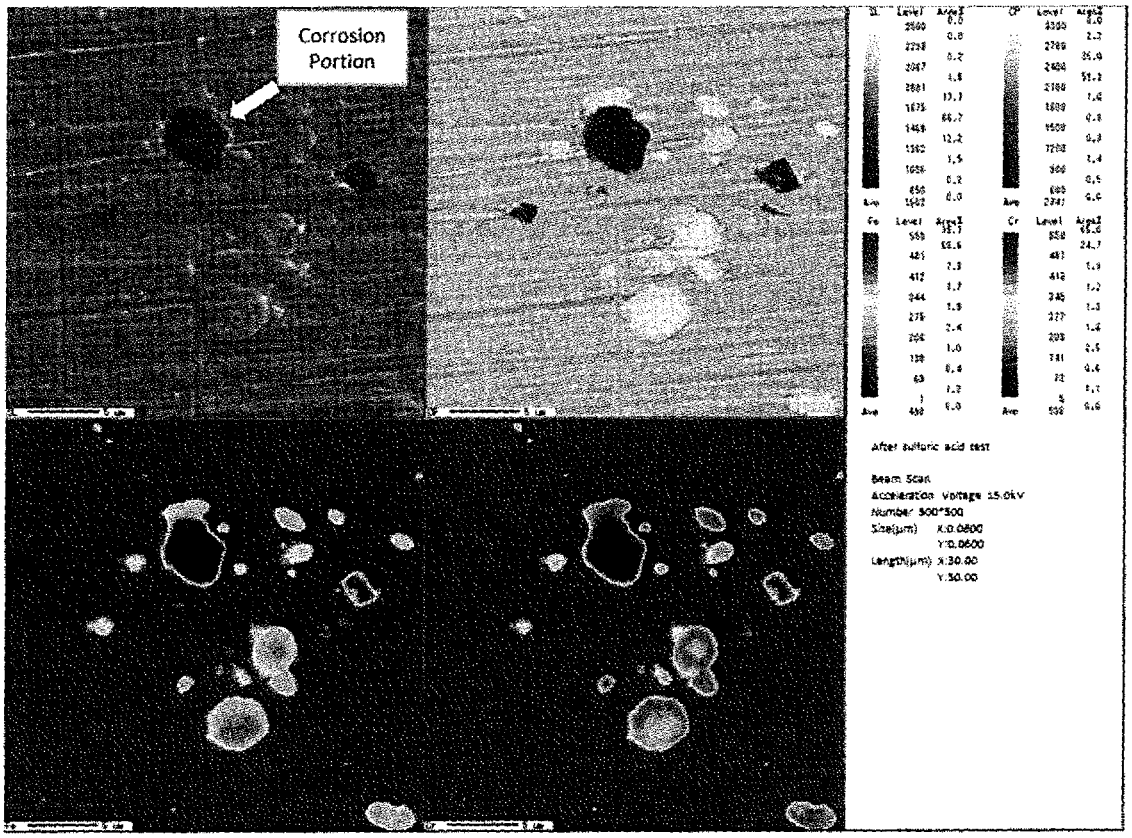
FIG. 2 shows images obtained by EPMA elemental mapping on the steel product of the present invention (Inventive Example 1) after having been immersed in the 98% sulfuric acid at 55° C. for 96 hours. A secondary electron image (SL) is shown at the upper left, a backscattered electron image (CP) at the upper right, Fe at the lower left, and Cr at the lower right.

FIG. 2 shows images obtained by EPMA elemental mapping on the steel product of the present invention (Inventive Example 1) after having been immersed in the 98% sulfuric acid at 55° C. for 96 hours.

As shown in FIG. 2, from the high intensities of Mg, Al, and O, it is seen that the pitting corrosion trace regions are due to $MgO.Al_2O_3$ inclusions.

Based on the fact that $MgO.Al_2O_3$ inclusions act as corrosion initiation sites, the present inventors investigated the relationship between the area fraction of $MgO.Al_2O_3$ inclusions and the corrosion rate.

It has been found that, when the area fraction of $MgO.Al_2O_3$ inclusions measured in the manner described below is not greater than 0.02%, excellent resistance to concentrated sulfuric acid is exhibited.

That is, by limiting the area fraction of $MgO.Al_2O_3$ inclusions to not greater than 0.02%, it is possible to reduce corrosion initiation sites, and as a result, a corrosion rate of not greater than 0.125 (mm/year), in a sulfuric acid concentration of 93% or greater, is achieved.

$MgO.Al_2O_3$ inclusions dissolve in a concentrated sulfuric acid solution, and once the matrix portion of the steel product of the present invention has become exposed, the progress of corrosion terminates. The area fraction of $MgO.Al_2O_3$ inclusions is preferably not greater than 0.015%. The lower limit of the area fraction of $MgO.Al_2O_3$ inclusions is not particularly specified, but preferably it is 0.010% from a cost standpoint.

(3-2) Average Particle Size: Not Greater Than 5.0 μm

In order to achieve excellent corrosion resistance, it is preferred that the $MgO.Al_2O_3$ inclusions have a form such that their average particle size is not greater than 5.0 μm.

When the average particle size is not greater than 5.0 μm, the $MgO.Al_2O_3$ inclusions will dissolve in a concentrated sulfuric acid solution to cause the base metal to be exposed, and as the corrosion progresses in the exposed base metal, Si in the base metal becomes enriched as an oxide in the surface of the base metal so that the progress of corrosion terminates. However, if $MgO.Al_2O_3$ inclusions having an average particle size of greater than 5.0 μm are present, the depth of the pitting corrosion will increase although depending on the plate thickness, and in some cases, a through hole may be formed. Thus, such average particle size is not preferred.

Accordingly, the average particle size of $MgO.Al_2O_3$ inclusions of not greater than 5.0 μm is preferred because excellent resistance to concentrated sulfuric acid can thereby be maintained. The average particle size is more preferably not greater than 3.0 μm. The lower limit of the average particle size is not particularly specified but preferably it is 1.0 μm.

The "area fraction" and the "average particle size" in the present invention can be determined in the following manner.

1) A test specimen is produced by embedding an area of 20 mm by 10 mm of a steel product to be examined in such a manner that the surface of the steel product can be an observation surface. (The plate surface needs to be observed because corrosion develops from the surface, which is subjected to contact with a solution.)

2) The test specimen is polished at the surface using emery paper and finish polished with #1200.
3) The finish polished test specimen is subjected to mapping analysis of Al, Mg, and O using an EPMA.
4) In the obtained mapping images, inclusions that exist at sites where Al, Mg, and O are all detected are assumed to be $MgO.Al_2O_3$ inclusions.
5) The area fraction is determined as follows: the mapping field of a 0.5 $mm^2$ area of the cross section of the sampled test piece, observed at a magnification of 100×, is subjected to image processing analysis, and after binarization, the area fraction of the inclusions is calculated by an image processing and analysis system. The number of fields to be observed is 30 fields or more.
6) The "average particle size" is defined as the equivalent circular diameter of the inclusions determined by the image processing and analysis after binarization.

That is, when the area fraction of $MgO.Al_2O_3$ inclusions is not greater than 0.02%, a corrosion rate of not greater than 0.1 (mm/year), in a sulfuric acid concentration of 93% or greater, is achieved. In addition, by reducing the size of the precipitates of $MgO.Al_2O_3$ inclusions to not greater than 5.0 μm, further reduction in the corrosion rate is achieved.

4. Production Method

The stainless steel product of the present invention may be produced by any production method as long as the chemical composition and the $MgO.Al_2O_3$ inclusions, described above, are satisfied. Described now is a preferred production method for obtaining $MgO.Al_2O_3$ inclusions that have the above-described area fraction, and moreover preferably the above-described average particle size.

(4-1) Steel-Making Process

In a steel-making process for producing the high Si content stainless steel of the present invention, it is believed that $MgO.Al_2O_3$ inclusions are formed in a manner as follows. MgO from the refractory brick of the ladle is dissociated by Al deoxidation, and the eluted Mg, dissolved oxygen, and $Al_2O_3$, which is the deoxidation product, react with each other as expressed by the following formulas (1) and (2).

$$3MgO+2Al=3Mg+Al_2O_3 \quad (1)$$

$$Mg+Al_2O_3+O=MgO.Al_2O_3 \quad (2)$$

An effective way to inhibit the formation of $MgO.Al_2O_3$ in the steel-making process is to limit the amount of Al to be supplied for deoxidation to a minimum required level in the AOD process (argon oxygen degassing process), and to use an Fe—Si master alloy to facilitate the reduction process in the case where the amount of Al to be supplied is to be reduced. A usable Fe—Si master alloy may be one having a low Al content. Preferably, a product of a grade of 0.5% or less Al content is used. In the AOD process, stirring by gas blowing is performed to cause the $MgO.Al_2O_3$ inclusions to agglomerate and float in the molten steel to be taken into the slag. This is done to exclude the $MgO.Al_2O_3$ inclusions from the system by slag removal that follows.

The slag after the reduction contains alumina. To prevent the alumina in the slag from being reduced in subsequent steps and included in the steel as Al to allow the reactions of the above formulas (1) and (2) to proceed, the slag removal after the AOD reduction process is to be performed carefully so that the alumina in the slag can be excluded from the system.

After the AOD process, the molten steel is decarburized by a VOD process to reduce the carbon content by converting the carbon to CO gas. Subsequently, an Fe—Si master alloy is fed to adjust the Si content to a predetermined amount. At this time as well, a product of low Al content, preferably of a grade of 0.5% or less Al content, is used. For the addition, the alloy is directly fed to the molten steel while slag cutting using a snorkel is being performed in order to prevent contact with the slag.

(Continuous Casting Process)

Thereafter, continuous casting is performed using a continuous casting machine. In order to reduce $MgO.Al_2O_3$ inclusions, a period of time is taken between the refining and the start of casting to promote floating of the inclusions to separate them. Also, electromagnetic stirring, for example, is used to enable floating and separation of the inclusions by causing agglomeration and coarsening of them.

As described above, by virtue of the synergistic effect of the stirring during AOD and the electromagnetic stirring during continuous casting, a stainless steel product is produced in which the area fraction and average particle size of $MgO.Al_2O_3$ inclusions are within the above-described range and which therefore exhibits excellent corrosion resistance to concentrated sulfuric acid.

EXAMPLES

A test described below was conducted to evaluate the corrosion resistances to concentrated sulfuric acid of stainless steel products of inventive examples while comparing them with the corrosion resistances to concentrated sulfuric acid of stainless steel products of comparative examples and conventional examples.

(1) Chemical Composition

The chemical compositions of the test specimens of Inventive Examples 1 to 14, Comparative Examples 1 to 7, and Conventional Examples 1 to 5 are shown together in Table 1.

TABLE 1

| Classification | | Chemical Composition (mass %, balance Fe and impurities) | | | | | | | | | | | | | | | |
|---|---|---|---|---|---|---|---|---|---|---|---|---|---|---|---|---|---|
| | | Cr | Ni | Si | Mn | Cu | No | Nb | Al | Mg | Ti | Zr | REM | N | C | P | S |
| Inventive examples | 1 | 17.1 | 14.3 | 4.68 | 0.98 | 0.48 | 0.42 | 0.51 | 0.011 | 0.002 | — | — | — | — | 0.030 | 0.004 | 0.005 |
| | 2 | 17.3 | 14.8 | 4.66 | 0.68 | 0.49 | 0.41 | 0.78 | 0.010 | 0.003 | — | — | — | — | 0.030 | 0.004 | 0.003 |
| | 3 | 17.6 | 14.2 | 4.59 | 0.79 | 0.47 | 0.44 | 0.97 | 0.013 | 0.002 | — | — | — | — | 0.040 | 0.005 | 0.004 |
| | 4 | 17.3 | 14.1 | 4.63 | 0.78 | 0.46 | 0.47 | 1.16 | 0.006 | 0.003 | — | — | — | — | 0.020 | 0.004 | 0.005 |
| | 5 | 15.8 | 15.4 | 4.10 | 0.95 | 0.42 | 0.49 | 0.52 | 0.009 | 0.002 | — | — | — | — | 0.030 | 0.004 | 0.005 |
| | 6 | 14.9 | 16.1 | 6.90 | 0.89 | 0.48 | 0.47 | 0.53 | 0.011 | 0.001 | — | — | — | — | 0.020 | 0.003 | 0.004 |
| | 7 | 11.1 | 13.4 | 4.66 | 0.91 | 0.46 | 0.47 | 0.52 | 0.008 | 0.004 | — | — | — | — | 0.030 | 0.003 | 0.004 |
| | 8 | 14.7 | 11.3 | 4.58 | 0.88 | 0.42 | 0.48 | 0.53 | 0.009 | 0.003 | — | — | — | — | 0.020 | 0.004 | 0.003 |
| | 9 | 16.6 | 14.8 | 4.61 | 0.87 | 0.18 | 0.47 | 0.51 | 0.011 | 0.004 | — | — | — | — | 0.020 | 0.003 | 0.003 |
| | 10 | 16.8 | 14.1 | 4.59 | 0.89 | 0.92 | 0.45 | 0.62 | 0.012 | 0.003 | — | — | — | — | 0.020 | 0.003 | 0.003 |

TABLE 1-continued

| Classification | | Chemical Composition (mass %, balance Fe and impurities) | | | | | | | | | | | | | | | |
|---|---|---|---|---|---|---|---|---|---|---|---|---|---|---|---|---|---|
| | | Cr | Ni | Si | Mn | Cu | No | Nb | Al | Mg | Ti | Zr | REM | N | C | P | S |
| | 11 | 16.5 | 14.3 | 4.55 | 0.91 | 1.46 | 0.48 | 0.55 | 0.009 | 0.003 | — | — | — | — | 0.020 | 0.004 | 0.002 |
| | 12 | 17.2 | 14.2 | 4.61 | 0.92 | 0.47 | 0.17 | 0.52 | 0.012 | 0.002 | — | — | — | — | 0.030 | 0.003 | 0.002 |
| | 13 | 17.1 | 14.6 | 4.52 | 0.93 | 0.48 | 0.97 | 0.51 | 0.009 | 0.002 | — | — | — | — | 0.020 | 0.002 | 0.002 |
| | 14 | 17.3 | 14.1 | 4.39 | 0.95 | 0.44 | 1.48 | 0.53 | 0.008 | 0.001 | — | — | — | — | 0.030 | 0.003 | 0.003 |
| Comparative Examples | 1 | 9.8* | 14.3 | 4.11 | 0.92 | 0.21 | 0.18 | 0.50 | 0.014 | 0.004 | — | — | — | — | 0.020 | 0.005 | 0.004 |
| | 2 | 16.8 | 13.9 | 3.70* | 0.92 | 0.20 | 0.19 | 0.52 | 0.044 | 0.005 | — | — | — | — | 0.020 | 0.006 | 0.004 |
| | 3 | 15.3 | 19.8* | 4.20 | 0.94 | 0.18 | 0.17 | 0.54 | 0.013 | 0.003 | — | — | — | — | 0.020 | 0.004 | 0.005 |
| | 4 | 17.1 | 14.3 | 5.80 | 0.74 | 0.32 | 0.41 | —* | 0.015 | 0.003 | — | — | — | — | 0.030 | 0.005 | 0.003 |
| | 5 | 16.8 | 13.9 | 4.60 | 0.74 | 1.62* | 0.39 | 0.53 | 0.016 | 0.005 | — | — | — | — | 0.030 | 0.005 | 0.004 |
| | 6 | 15.9 | 14.8 | 4.30 | 0.84 | 0.51 | 1.59* | 0.52 | 0.018 | 0.003 | — | — | — | — | 0.040 | 0.006 | 0.005 |
| | 7 | 17.0 | 14.9 | 4.51 | 1.53* | 0.51 | 0.45 | 0.51 | 0.015 | 0.004 | — | — | — | — | 0.040 | 0.006 | 0.005 |
| Conventional examples | 1 | 11.1 | 16.5 | 4.25 | 0.98 | — | 0.20 | — | 0.700 | 0.010 | 0.1 | 0.4 | Mm: 0.1 | 0.120 | 0.020 | 0.020 | 0.020 |
| | 2 | 14.1 | 15.5 | 5.90 | 0.55 | 0.96 | 0.98 | — | 0.055 | 0.013 | — | — | — | 0.010 | 0.020 | 0.003 | 0.003 |
| | 3 | 17.2 | 19.4 | 5.38 | 0.62 | 2.14 | 0.41 | — | 0.067 | 0.022 | — | — | — | 0.022 | 0.014 | 0.004 | 0.005 |
| | 4 | 17.6 | 17.1 | 5.54 | 0.59 | 0.01 | 0.03 | — | 0.170 | 0.011 | — | — | — | 0.005 | 0.012 | 0.006 | 0.003 |
| | 5 | 17.1 | 13.9 | 4.25 | 1.05 | 0.02 | 0.03 | — | 0.046 | 0.012 | — | — | — | 0.005 | 0.012 | 0.006 | 0.003 |

*means it does not meet the claimed range.

(2) Method for Producing Test Specimen (2-1) Inventive Example 1

In Example 1, the influence of the chemical composition was investigated. To make the investigation, laboratory melting using a test furnace was carried out by the following procedure.

(i) 17 kg/ch of material was charged into a 30 kg/ch vacuum high frequency induction melting furnace and was cast in a round ingot mold.

(ii) After heating at 1180° C. for 2 hours, hot forging was performed to form a forged material of 50 mm thickness by 120 mm width by L length, and then rolling was performed to produce two hot rolled blanks of 45 mm thickness by 120 mm width by 150 mm length.

(iii) Thereafter, the two hot rolled blanks were heated at 1180° C. for 90 minutes and reheated at not lower than 900° C., and one of them was formed into 5.5 mm thickness by 120 mm width by L length and the other was formed into 11 mm thickness by 120 mm width by L length.

(iv) The 5.5 mm thickness steel product was solution treated by being held at 1130° C. for 15 minutes and water cooled, and the 11 mm thickness product was solution treated by being held at 1130° C. for 30 minutes and water cooled.

Figure 3:
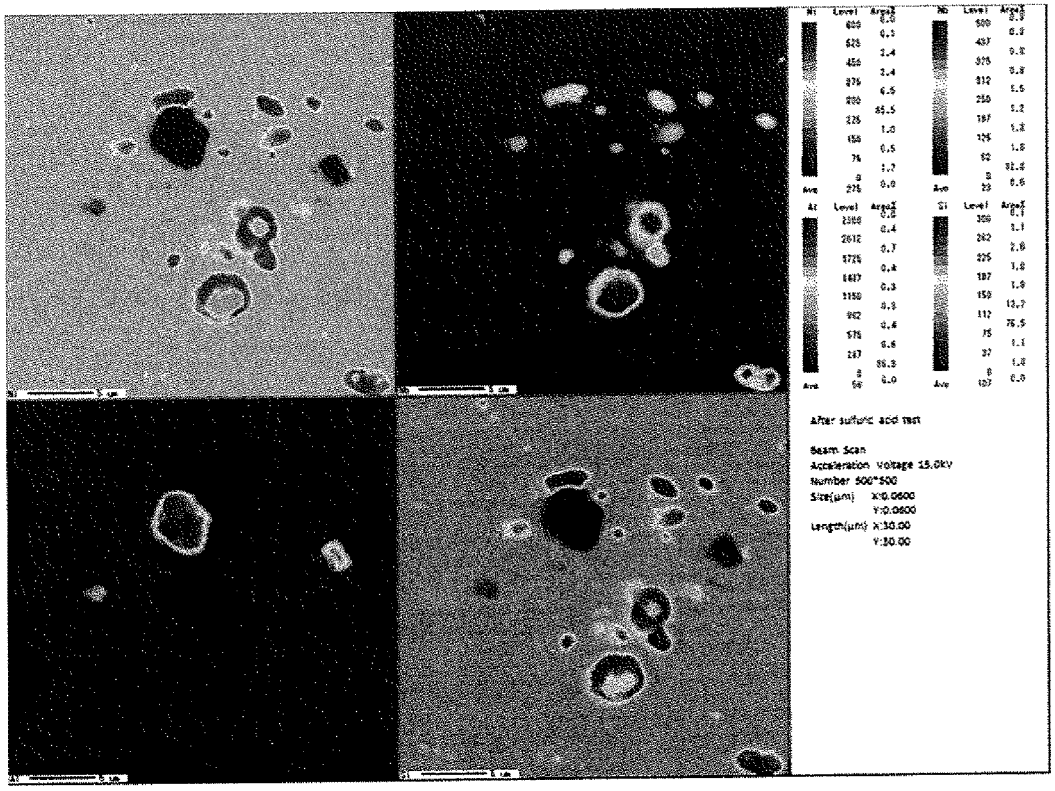
FIG. 3 shows images obtained by EPMA elemental mapping on the steel product of the present invention (Inventive Example 1) after having been immersed in the 98% sulfuric acid at 55° C. for 96 hours. Ni is shown at the upper left, Nb at the upper right, Al at the lower left, and Si at the lower right.
Figure 4:
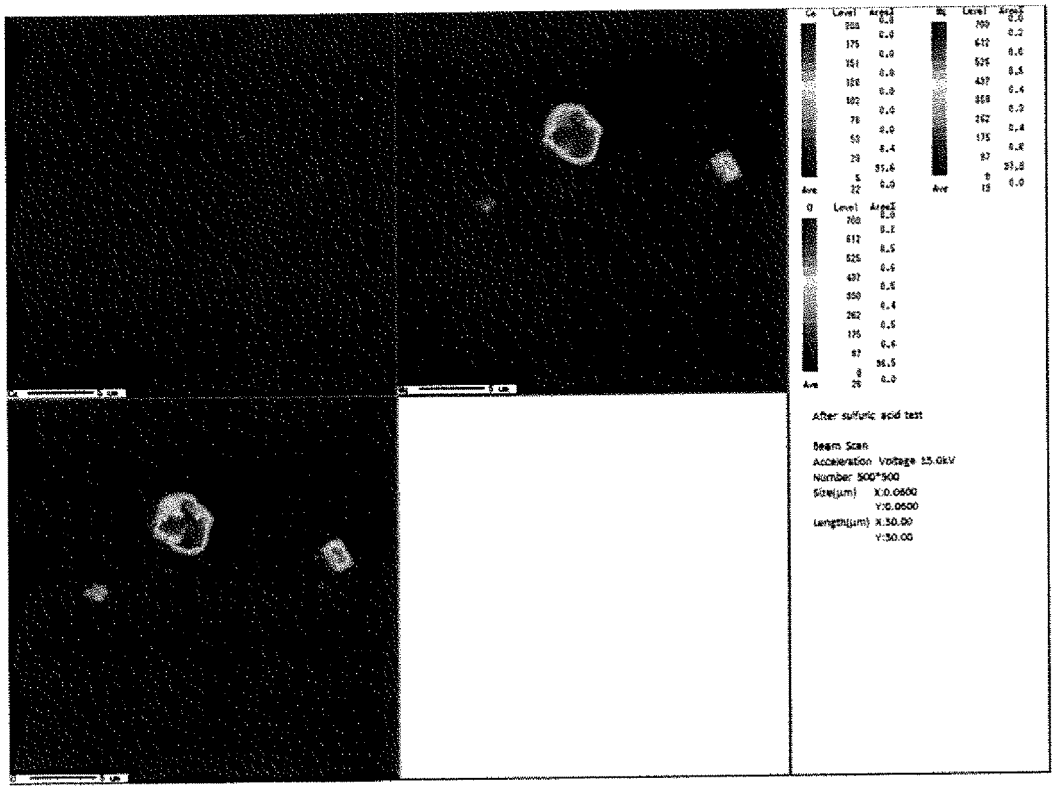
FIG. 4 shows images obtained by EPMA elemental mapping on the steel product of the present invention (Inventive Example 1) after having been immersed in the 98% sulfuric acid at 55° C. for 96 hours. Ca is shown at the upper left, Mg at the upper right, and O at the lower left.
Figure 5:
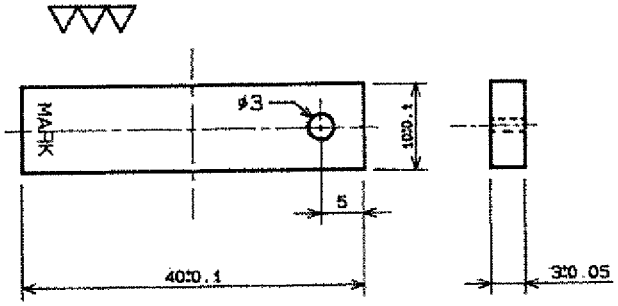
FIG. 5 is an illustration of a corrosion test specimen.

(v) From the obtained 5.5 mm thickness steel product, a corrosion test specimen as illustrated in FIG. 3 was cut by machining to be used for investigation of corrosion resistance. From the 11 mm thickness steel product, two test specimens of 10 mm thickness by 110 mm width by 200 mm were cut similarly by machining to be subjected to a FISCO test (C-shaped jig restraining butt weld cracking test) in accordance with JIS Z 3155.

(2-2) Example 2

In Example 2, the influence of MgO-A1203 inclusions was examined and investigated.

A material having the chemical composition of Inventive Example 1 in Table 1 was processed through electric furnace-AOD-VOD-ladle refining to be formed into a slab of 200 mm thickness and cut into cast pieces of a predetermined size, and then heated to 1180° C. and hot rolled with reheating, to thereby produce a hot rolled plate of 6 mm thickness. After the hot rolling, holding at 1130° C. for 15 minutes and subsequent water cooling were carried out. The casting conditions are shown in Table 2. The stirring by gas blowing in the AOD process was Ar stirring for 7 minutes with a ladle volume of 150 tons and an Ar blowing rate of 75000 $Nm^3$/minute.

TABLE 2

| Classifications | | Materials: Addition of Al for deoxidation in AOD process | Materials: Al content of Fe—Si alloy*1 | Slag removal Expose rate of base metal after slag removal | Refining (ladle): Use of snorkel | Refining (ladle): Period time until start of casting (min) | CC: Electromagnetic stirring | CC: Drawing rate (m/min) |
|---|---|---|---|---|---|---|---|---|
| Laboratory melting (Inventive Example 1) | | — | — | — | — | — | — | — |
| Inventive Examples | A | No addition | 0.09% | ≥90% | Yes | 25 | Done | 0.5 |
| | B | No addition | 0.12% | ≥90% | Yes | 25 | Done | 0.5 |

TABLE 2-continued

| | | | | | | | | |
|---|---|---|---|---|---|---|---|---|
| | C | No addition | 0.12% | ≥90% | Yes | 20 | Done | 0.5 |
| | D | No addition | 0.12% | ≥90% | Yes | 18 | Done | 0.5 |
| | E | No addition | 0.12% | ≥90% | Yes | 20 | Done | 0.8 |
| Comparative Examples | F | No addition | 0.12% | ≥90% | Yes | 20 | No | 0.5 |
| | G | No addition | 1.80% | ≥90% | Yes | 20 | Done | 0.5 |
| | H | No addition | 0.12% | 65% | Yes | 20 | Done | 0.5 |
| | I | No addition | 0.12% | ≥90% | No | 20 | Done | 0.5 |
| | J | Done | 0.12% | ≥90% | Yes | 20 | Done | 0.5 |

| | | $MgO \bullet Al_2O_3$ inclusions | | Investigation on | | | |
|---|---|---|---|---|---|---|---|
| | | Area | Average grain | Resistance to Sulfuric Acid (corosion rate mm/year) | | | |
| Classifications | | fraction (%) | size (μm) | 93% 50° C. | 95% 60° C. | 98% 90° C. | Evaluation*2 |
| Laboratory melting (Inventive Example 1) | | 0.012 | 2.1 | 0.089 | 0.039 | 0.011 | ○ |
| Inventive Examples | A | 0.013 | 2.9 | 0.09 | 0.042 | 0.012 | ○ |
| | B | 0.013 | 3.8 | 0.092 | 0.041 | 0.012 | ○ |
| | C | 0.017 | 4.1 | 0.094 | 0.048 | 0.013 | ○ |
| | D | 0.018 | 4.4 | 0.097 | 0.051 | 0.014 | ○ |
| | E | 0.018 | 5.2 | 0.122 | 0.077 | 0.022 | Δ |
| Comparative Examples | F | 0.025 | 6.2 | 0.178 | 0.089 | 0.028 | x |
| | G | 0.041 | 7.3 | 0.167 | 0.088 | 0.033 | x |
| | H | 0.033 | 6.1 | 0.162 | 0.079 | 0.031 | x |
| | I | 0.042 | 7.7 | 0.185 | 0.091 | 0.035 | x |
| | J | 0.083 | 5.2 | 0.132 | 0.077 | 0.029 | x |

*1use of Ferrosilicons No. 2 of different Al contents

*2○ ≤0.1 mm/year, Δ ≤0.125 mm/year, x >0.125 mm/year

Subsequently, pickling was performed on the surface to remove scale, and then the specimen was subjected to investigation of the area of inclusions, investigation of the size of inclusions, and a corrosion test.

In order to create various states in which inclusions may exist, variations were made regarding, e.g., addition or no addition of Al for deoxidation, use of Ferrosilicons No. 2 of different Al contents, and process conditions from refining through CC, as shown in Table 2.

(3) Investigation on Corrosion Resistance to Concentrated Sulfuric Acid

The corrosion test specimens as illustrated in FIG. 3 were immersed in a 93% sulfuric acid solution at 60° C., a 95% sulfuric acid solution at 60° C., and a 98% sulfuric acid solution at 90° C., for 96 hours, and the corrosion rates were calculated from the corrosion weight losses.

(4) Weld Cracking Susceptibility Test

The cracking susceptibility during welding was evaluated by conducting a C-shaped jig restraining butt weld cracking test method in accordance with JIS Z 3155.

(4-1) Shape of Test Specimen

For each product, two test specimens of 10 mm thickness by 110 mm width by 200 mm were prepared. The groove shape was the I shape. The root opening g of the test plate was 2 mm.

(4-2) Welding Material Used

A coated arc welding rod of 3.2 mm diameter having a chemical composition of C: 0.019%, Si: 4.55%, Mn: 1.02%, Ni: 14.02%, and Cr: 17.87% was used.

(4-3) Welding Conditions

Welding work was performed with the current controlled to be within a range of 90 to 110 A.

(5) Investigation on Size of $MgO.Al_2O_3$ Inclusions

An area of 20 mm by 10 mm of the prepared steel product was embedded in such a manner that the surface of the steel product can be an observation surface. (The plate surface was observed because corrosion develops from the surface, which is subjected to contact with a solution.) Then, polishing was performed on the surface using emery paper, which was followed by finish polishing with #1200.

The finish polished specimen was examined by an EPMA for mapping analysis of Al, Mg, and O.

The analyzer was JXA-8100 manufactured by JEOL Ltd., and the analysis conditions included an acceleration voltage of 20 kV and a magnification of 100×.

In the obtained mapping images, portions where Al, Mg, and O are all detected can be considered to be $MgO.Al_2O_3$ inclusions, and therefore, presuming that the detected portions are $MgO.Al_2O_3$ inclusions, the area fraction was calculated. The area fraction is an area fraction of the inclusions calculated by binarizing the mapping field and processing it with an image processing analyzing system. In this example, the average value of 40 fields was used. For the "average particle size", image processing analysis, after binarization, was performed to determine the equivalent circular diameter of the inclusions (average of 40 fields), and this equivalent diameter was designated as the average particle size.

The area fraction and the average particle size were calculated using LUZEX AP manufactured by NITRECO CORPORATION.

Furthermore, from the mapping images, the average particle size of $MgO.Al_2O_3$ inclusions was estimated.

(6) Test Results

Test results regarding Example 1 are shown together in Table 3.

As shown in Table 3, Inventive Examples 1 to 14 have corrosion resistances comparable to or higher than those of Conventional Examples 1 to 5, and has excellent properties regarding weld cracking resistance compared with them. In the following, results of Examples 1 and 2 will be described.

(6-1) Example 1

To exclude the influence of inclusions, clean test specimens were prepared using laboratory melting, and their corrosion resistances and weld cracking resistances were evaluated.

As shown in Table 3, one advantage of the inventive examples is the low weld cracking susceptibilities compared with those of Conventional Examples 1 to 5, with the Fisco crackings of Inventive Examples 1 to 14 all being not greater than 1%.

The effect of Nb can be understood by comparing Inventive Examples 1 to 4 with Comparative Example 4. Specifically, Nb forms carbides and nitrides and produces the pinning effect to inhibit the grain growth of the crystal grains and refine the crystal grains, and therefore has the effect of improving the formability. Furthermore, within an appropriate range of content, Nb fixes C or N to inhibit formation of Cr carbo-nitrides, which are responsible for formation of the Cr depleted layer, and thereby inhibits sensitization in the base metal and weld heat affected zone.

TABLE 3

| | | $MgO•Al_2O_3$ Inclusions | | | | | | Result of Fisco cracking Test | | | |
|---|---|---|---|---|---|---|---|---|---|---|---|
| | | Area | Average grain | Investigation on Resistance to Sulfuric Acid (corosion rate mm/year) | | | | Total bead | Total crack | Cracking | |
| Clasifications | | fraction (%) | size (μm) | 93% 60° C. | 95% 60° C. | 98% 90° C. | Evaluation*1 | length (mm) | length (mm) | rate (%) | Evaluation*2 |
| Inventive Examples | 1 | 0.012 | 2.1 | 0.089 | 0.039 | 0.011 | ○ | 165.2 | 1.2 | 0.73 | ○ |
| | 2 | 0.014 | 2.8 | 0.094 | 0.038 | 0.012 | ○ | 165.3 | 0.9 | 0.54 | ○ |
| | 3 | 0.012 | 1.8 | 0.094 | 0.039 | 0.013 | ○ | 167.2 | 0.0 | 0.00 | ○ |
| | 4 | 0.013 | 1.9 | 0.092 | 0.032 | 0.001 | ○ | 164.3 | 0.0 | 0.00 | ○ |
| | 5 | 0.012 | 2.3 | 0.097 | 0.064 | 0.014 | ○ | 163.9 | 0.3 | 0.18 | ○ |
| | 6 | 0.014 | 1.6 | 0.077 | 0.041 | 0.007 | ○ | 165.4 | 0.0 | 0.00 | ○ |
| | 7 | 0.011 | 1.5 | 0.099 | 0.055 | 0.014 | ○ | 165.9 | 0.4 | 0.24 | ○ |
| | 8 | 0.013 | 1.4 | 0.082 | 0.050 | 0.015 | ○ | 158.6 | 0.0 | 0.00 | ○ |
| | 9 | 0.015 | 1.6 | 0.097 | 0.062 | 0.016 | ○ | 159.4 | 1.1 | 0.69 | ○ |
| | 10 | 0.013 | 2.1 | 0.083 | 0.053 | 0.011 | ○ | 162.3 | 0.7 | 0.43 | ○ |
| | 11 | 0.016 | 2.3 | 0.071 | 0.049 | 0.010 | ○ | 159.4 | 0.0 | 0.00 | ○ |
| | 12 | 0.011 | 2.3 | 0.083 | 0.052 | 0.016 | ○ | 160.3 | 0.0 | 0.00 | ○ |
| | 13 | 0.013 | 2.1 | 0.069 | 0.037 | 0.014 | ○ | 162.1 | 0.6 | 0.37 | ○ |
| | 14 | 0.012 | 1.9 | 0.059 | 0.035 | 0.014 | ○ | 159.3 | 0.9 | 0.56 | ○ |
| Comparative Examples | 1 | 0.014 | 2.3 | 3.7 | 0.21 | 0.11 | X | 164.3 | 0.7 | 0.43 | ○ |
| | 2 | 0.016 | 2.1 | 4.4 | 0.33 | 0.14 | X | 163.2 | 0.4 | 0.25 | ○ |
| | 3 | 0.012 | 2.6 | 0.092 | 0.044 | 0.013 | ○ | 164.3 | 2.3 | 1.40 | X |
| | 4 | 0.017 | 2.1 | 0.096 | 0.051 | 0.015 | ○ | 162.1 | 42.1 | 25.97 | X |
| | 5 | 0.013 | 2.4 | 0.088 | 0.039 | 0.016 | ○ | 165.3 | 15.1 | 9.13 | X |
| | 6 | 0.011 | 1.7 | 0.092 | 0.056 | 0.011 | ○ | 165.3 | 17.3 | 10.47 | X |
| | 7 | 0.016 | 1.3 | 0.32 | 0.18 | 0.11 | X | 164.0 | 0.8 | 0.49 | ○ |
| Conventional examples | 1 | 0.14 | 5.3 | 2.1 | 1.1 | 0.61 | X | 165.8 | 60.2 | 36.31 | X |
| | 2 | 0.11 | 5.4 | 0.094 | 0.038 | 0.016 | ○ | 159.3 | 21.6 | 13.56 | X |
| | 3 | 0.031 | 6.1 | 0.13 | 0.078 | 0.022 | X | 164.1 | 13.3 | 8.10 | X |
| | 4 | 0.044 | 5.2 | 0.11 | 0.098 | 0.051 | X | 162.2 | 14.2 | 8.75 | X |
| | 5 | 0.022 | 3.1 | 0.12 | 0.096 | 0.072 | X | 163.1 | 0.9 | 0.55 | ○ |

*1 ○ ≤0.1 mm/year, X >0.1 mm/year
*2 ○ <1.0%, X ≥1.0%

As shown in Table 3, the stainless steel products of Inventive Examples 1 to 14 exhibit excellent corrosion resistance to concentrated sulfuric acid solution. The corrosion rates in 93 to 98% concentrated sulfuric acid solutions are not greater than 0.125 (mm/year).

In the elemental mapping images of FIG. 2, the sites of high Nb concentration (considered to be Nb) do not act as a corrosion initiation site, and therefore it is presumed that NbC does not have the effect of decreasing the resistance to concentrated sulfuric acid. In addition, it is seen that the chemical composition of the present invention produces the effect of decreasing the weld cracking susceptibility.

From the results of Inventive Examples 1 to 4 and Comparative Example 4, it is found that the Fisco cracking susceptibility tends to decrease with increasing Nb content It is seen that the Nb content of not less than 0.5% is necessary to produce this effect.

Next, the effect of Si can be understood by comparing Inventive Examples 5 and 6 with Comparative Example 2. Specifically, the Si oxide film is insoluble in concentrated sulfuric acid, and therefore Si is an element that guarantees corrosion resistance. Comparative Example 2, in which the Si content is less than 4.0%, exhibits poor corrosion resistance in a 93% sulfuric acid environment. In contrast, Inventive Examples 5 and 6, in each of which the Si content is not less than 4.0%, have a corrosion rate of not greater than 0.1 (mm/year) even in a 93% sulfuric acid environment and therefore are corrosion resistant.

Next, the effect of Cr can be understood by comparing Inventive Example 7 with Comparative Example 1. Cr is an element that contributes to corrosion resistance by forming a passivation film in the surface of a stainless steel, but in a highly oxidizing concentrated sulfuric acid, Cr causes transpassive dissolution. From this phenomenon, Cr may be considered to be not very contributory to improvement in corrosion resistance, but from Inventive Example 7 and Comparative Example 1, it is seen that, in a 93% sulfuric acid, which is less oxidizing than a 98% sulfuric acid, Cr produces the effect of improving corrosion resistance.

Next, the effect of Ni can be understood by comparing Inventive Example 8 with Comparative Example 3. Specifically, Ni is a useful element for achieving corrosion resistance, but in view of Comparative Example 3, in which the Fisco cracking is greater than 1%, it is seen that a high Ni content results in a deterioration in weld cracking susceptibility.

Next, the effect of Cu can be understood by comparing Inventive Examples 9 to 11 with Comparative Example 5. Specifically, in a 93% sulfuric acid, which is less oxidizing than a 98% sulfuric acid, Cu produces the effect of improving corrosion resistance. However, Cu poses the problem of causing a decrease in hot workability. In addition, in view of Comparative Example 5, in which the Fisco cracking is greater than 1%, it is seen that a high Cu content results in a deterioration in weld cracking susceptibility.

Next, by comparing Inventive Examples 12 to 14 with Comparative Example 6, it is observed that Mo has the effect of improving corrosion resistance in a 93% sulfuric acid, which is less oxidizing than a 98% sulfuric acid. However, in view of Comparative Example 6, in which the Fisco cracking is greater than 1%, it is seen that a high Mo content results in a deterioration in weld cracking susceptibility.

From the results of Example 1 described above, it has been observed that satisfying the chemical composition of the present invention results in a corrosion rate of not greater than 0.1 (mm/year) and also a Fisco cracking of not greater than 1%, in 93 to 98% concentrated sulfuric acid solutions.

In contrast, it is seen that Conventional Examples 1 to 5 cannot achieve corrosion resistance and weld cracking susceptibility in combination.

(6-2) Example 2

In Example 1, a laboratory melted material was used to conduct the experiment and verification on a case in which the area fraction and the size of $MgO.Al_2O_3$ inclusions are small. In contrast, in Example 2, the case of actual production was investigated for the influence of the area fraction and the size of $MgO.Al_2O_3$ inclusions using a cast slab material of 200 mm thickness formed by continuous casting. Since it is difficult to conduct investigations on many compositions, specimens having the chemical composition of Inventive Example 1 were used for the investigation. The results are shown together in Table 2 above.

As shown in Inventive Examples A to D in Table 2, when the area fraction of $MgO.Al_2O_3$ inclusions is not greater than 0.02% and also the average particle size of the $MgO.Al_2O_3$ inclusions is not greater than 5.0 μm, the corrosion rate of not greater than 0.1 (mm/year) is achieved against 93% to 98% concentrated sulfuric acids.

Furthermore, as shown in Inventive Example E in Table 2, when the area fraction of $MgO.Al_2O_3$ inclusions is not greater than 0.02%, the corrosion rate of not greater than 0.125 (mm/year) is achieved against 93 to 98% concentrated sulfuric acids.

From the results described above, it is clear that stainless steel products having the chemical composition of the present invention, which has been demonstrated in Example 1, exhibit excellent corrosion resistance to concentrated sulfuric acid because the area fraction and average particle size of $MgO.Al_2O_3$ inclusions are controlled to be within the appropriate ranges.

As described above, stainless steel products of the present invention exhibit excellent corrosion resistance to concentrated sulfuric acid (a corrosion rate of not greater than 0.125 (mm/year) in 93 to 98% concentrated sulfuric acid solutions). Furthermore, stainless steel products of the present invention have corrosion resistance comparable to or higher than those of conventional stainless steel products and have excellent properties regarding weld cracking resistance compared with them.

Therefore, the present invention provides stainless steel products having excellent resistance to concentrated sulfuric acid and which therefore are able to form, for example, equipment for producing hot concentrated sulfuric acid or plant equipment for producing chemicals, fertilizers, fibers, or others that are obtainable by using sulfuric acid as a basic material.

The invention claimed is:

1. A stainless steel product comprising a chemical composition consisting of, by mass, C: less than 0.05%,
Si: 4.0 to 7.0%,
Mn: 1.50% or less,
P: 0.030% or less,
S: 0.030% or less,
Cr: 10.0 to 20.0%,
Ni: 11.0 to 17.0%,
Cu: 0.15 to 1.5%,
Mo: 0.15 to 1.5%,
Nb: 0.5 to 1.2%,
Sol. Al: 0 to 0.10%,
Mg: 0.001 to 0.01%, and
balance Fe and impurities, wherein $MgO.Al_2O_3$ inclusions constitute an area fraction of 0.010% or more, 0.02% or less.

2. The stainless steel product according to claim 1, wherein the $MgO.Al_2O_3$ inclusions have an average particle size of 5.0 μm or less.

* * * * *